US006457344B2

(12) United States Patent
Godin

(10) Patent No.: US 6,457,344 B2
(45) Date of Patent: Oct. 1, 2002

(54) BENDER STAND

(76) Inventor: Jeffrey Godin, 10 Pleasant Hill Dr., Waterville, ME (US) 04901

( * ) Notice: Subject to any disclaimer, the term of this patent is extended or adjusted under 35 U.S.C. 154(b) by 0 days.

(21) Appl. No.: 09/774,784

(22) Filed: Jan. 30, 2001

Related U.S. Application Data

(60) Provisional application No. 60/180,705, filed on Feb. 7, 2000.

(51) Int. Cl.[7] ..... B21D 7/04
(52) U.S. Cl. ..... 72/458; 72/459
(58) Field of Search ..... 72/458, 459, 460

(56) References Cited

U.S. PATENT DOCUMENTS

| | | | | |
|---|---|---|---|---|
| 1,761,798 A | * | 6/1930 | Potter | 72/458 |
| 1,835,264 A | * | 12/1931 | Blythe | 72/459 |
| 1,899,281 A | * | 2/1933 | Lidseen | 72/458 |
| 3,735,621 A | | 5/1973 | Dodge | |
| 3,869,917 A | | 3/1975 | Lapp | |
| 3,949,584 A | | 4/1976 | Pearson et al. | |
| 4,196,610 A | | 4/1980 | Chilton | |
| 4,442,695 A | | 4/1984 | Gardner | |
| 4,452,064 A | | 6/1984 | Custin | |
| 4,546,632 A | | 10/1985 | Van Den Kieboom et al. | |
| 4,622,837 A | | 11/1986 | Bergman | |
| 4,638,665 A | | 1/1987 | Benson | |
| 4,691,555 A | | 9/1987 | Vaughan | |
| 4,926,672 A | * | 5/1990 | Swanson | 72/458 |
| 5,058,407 A | * | 10/1991 | Parker | 72/37 |
| 5,499,521 A | | 3/1996 | Luikart et al. | |
| 5,502,997 A | | 4/1996 | Boettger et al. | |
| 5,934,132 A | | 8/1999 | Nichol | |
| 6,009,737 A | | 1/2000 | Bandy | |

* cited by examiner

*Primary Examiner*—David Jones
(74) *Attorney, Agent, or Firm*—Pierce Atwood

(57) ABSTRACT

A conduit bending support device to facilitate conduit bending using a hand bender. The device includes a structural base and a support assembly. The support assembly includes a frame and a hand bender securing frame rotatably connected to the frame. The securing frame includes a clamping mechanism for releasably clamping the hand bender in a selectable position. The base includes a primary frame and an optional frame extension captured by the primary frame. The base also includes an adjustable conduit support to permit a user to support conduit thereon during the bending process.

19 Claims, 3 Drawing Sheets

BENDER STAND

CROSS REFERENCE TO RELATED APPLICATION

This application claims priority benefit in U.S. provisional application serial No. 60/180,705 filed Feb. 7, 2000, of the same title and by the same inventor. The content of that application is incorporated herein by reference.

BACKGROUND OF THE INVENTION

1. Field of the Invention

The present invention relates to bending devices for pipes, tubes, and conduits. More particularly, the present invention relates to devices to assist in using hand benders. Still more particularly, the present invention relates to a stand for increasing the use capability and portability of hand benders.

2. Description of the Prior Art

Benders are used to form straight runs of conduit (or pipe or tube) at particular angles in order to conform to surface structures to which they are coupled. Conduit benders are particularly useful in the electrical trades for establishing runs through which wiring is passed without kinking, getting snagged, or generally having an unsightly appearance when the conduit is applied to exterior walls.

For the most part, there are three types of benders used by those in the trades. The first is a hand bender and the second is an automated machine bender. The hand bender is relatively inexpensive in comparison to the machine bender. It includes a handle section and a head or shoe. The head includes an curved conduit capturing recess. A straight piece of conduit is inserted into the recess and the user restrains one end of the conduit while rotating the handle to cause the conduit to curve in conformance with the arc of the recess. The hand bender is limited in that it can only produce one bend angle, the most common being a 90° bend. Unfortunately, the user may wish to bend the conduit at other angles and so is required to purchase benders having differing recess curves.

Further, hand benders are limited in that they can only be used to create, at least easily, a single bend in the conduit. There are, however, times when a conduit run must have multiple bends in order to conform to surfaces having multiple protrusions. However, hand benders cannot be used to establish multiple bends in a single run without going through significant contortions. This can be a time consuming and frustrating process that may require experimentation and unacceptable conduit shape. All of this can lead to increased cost for a particular project, even when using a low-cost hand bender.

The automated machine bender is a viable alternative to the hand bender and is particularly suited to formation of conduits with multiple angles. Further, it is likely to reduce the time required to form conduit with multiple bends. Nevertheless, the cost of automated benders is seen to be cost prohibitive for many tradespeople. In addition, for the individual tradesperson, an automated bender is generally not sufficiently portable to enable a single person to maneuver it from one job site to another. Unfortunately, they appear to be too large to conveniently stow away in a secured location on a job site (such as a lockbox), but not so big that they cannot be pilfered. In addition, they require access to electricity in order to operate. When at a site remote from conventional electrical outlets, a generator is required.

The third type of bender is a mechanical bender. The mechanical benders presently available are bulky, hard to operate, and difficult to transport easily. For that reason, they tend to be permanent-type fixtures not generally suited for the individual having his or her own bending equipment to be moved from one job to another.

An example of an automated bender is described in U.S. Pat. No. 4,546,632 issued to Van Den Kieboom et al. The Van Den Kieboom automated bender includes a rolling cart and requires an electrical power supply to operate. There are often situations where the user may not have easy access to an electrical supply, thereby making such a bender ineffective at remote or non-supplied sites. Further, such relatively complex systems are prone to failures that may require periodic expected and unexpected costly maintenance, driving the real price of the device much higher than the original purchase price. U.S. Pat. No. 3,949,584 issued to Pearson et al. describes a similar type of automated bender and therefore has similar limitations associated generally with such automated systems.

Therefore, what is needed is a device to enable bending of conduit, pipe, or tube at selectable angles. Further, what is needed is such an assistive conduit bending device that enables the formation of multiple bends of a conduit. Yet further, what is needed is an assistive conduit bending device that is relatively transportable by a single individual and that can be secured with convenient job site storage means. What is also needed is such an assistive device that is not as complex, power-supply dependent or costly as existing automated benders.

SUMMARY OF THE INVENTION

It is an object of the present invention to provide an assistive device to enable hand bending of conduit, pipe, or tube at selectable angles. It is also an object of the present invention to provide an assistive conduit-bending device that enables the formation of multiple bends of a conduit. Further, it is an object of the present invention to provide an assistive conduit bending device that is relatively transportable by a single individual and that can be secured with convenient storage means. Yet further, it is an object of the present invention to provide such an assistive device that is not as complex, power-supply dependent or costly as existing automated benders. Thus, it is an object of the invention to convert a conventional hand bender into a modular mechanical conduit bending system.

These and other objects are achieved with the present invention, which is a stand for use with a hand bender of selectable angle type. The assistive bender stand includes a bender securing assembly and a base that provides the foundation and, when necessary, leverage, to bend conduit, pipe, or tube, as desired. The combination of the bender securing assembly and the base, which may optionally be of adjustable dimensions, enables a user to leverage the capability of an inexpensive hand bender into formation of accurate bends. Moreover, the securing assembly and base combination firmly fixes the handle portion of the bender in a stationary position not subject to random movements of the user.

The securing assembly includes a releasable and adjustable bender securing frame and a support frame that is removably couplable to the base. The securing frame may be fixedly or preferably rotatably couplable to the support frame so that the position of the hand bender secured therein may be adjusted as desired and so that a centerline of the conduit may be maintained through a bending. The securing frame includes a handle capturing section that may either be formed in recesses of opposing faces of that section or that may be applied to those opposing faces. The securing frame is preferably formed of material sufficiently rigid to withstand the type of stresses that may be expected in the course of bending conduit, pipe or tubing. One material found to be suitable is steel coated with an oxidation prevention material; however, those skilled in the art that the device may be formed of a material other than steel.

The base of the stand includes an attachment section for connecting to the securing assembly. It also includes a primary frame that is designed to be set in place on a substrate and forms the structural foundation for the assistive bender stand of the present invention. Additionally, a slidable frame extension assembly may be slidably secured to the primary frame to provide supplemental leverage support in the event a particular conduit is long or of greater-than-average rigidity.

The base assembly may further include a conduit support bar that is detachably connected to the primary frame. The conduit support bar is coupled to a bar frame so that the height of the support bar with respect to the primary frame may be of adjustable height. The support bar is preferably formed of a material, or at least coated with a material, that allows for smooth passage of a conduit to be shaped. A variety of low-friction materials or coatings may be suitable for that purpose including, but not limited to, polyethylene tubing.

The support bar provides a height dimension to the overall structure of the device of the present invention that enables the formation of multiple bends in a single conduit run. Specifically, prior hand bending required placement of the conduit on a surface, such as a floor, to provide the user with the leverage necessary to create the bend of selected height. However, in that situation, after the first shaping of the conduit, it is not possible to make a second opposing bend, for example. The adjustable height of the support bar provides the height differential necessary to create multiple bends in a single conduit run while maintaining the necessary leverage to form those bends. Further, the support bar compensates for radius changes associated with the various hand benders available including, but not limited to, the ½", ¾", 1", and 1¼" hand benders, which benders are fixed at radii of 5", 6", and 7", respectively. Through use of the support bar, the conduit is maintained level throughout the bending process and in order to maintain a 90° bend when desired.

The combination of the securing frame and the support frame of the present invention provide a convenient stand that allows a user to greatly increase the capabilities of a relatively inexpensive hand bender. In particular, the user need only obtain the stand of the present invention and one or more hand benders of selectable head angles to create a mechanical hand bending system that is portable and therefore usable for a variety of applications. In addition, combining the present stand device with a hand bender and a conduit level such as The Eliminator™ offered by Bending Technologies, Inc. of Fairfield, Me., ensures easy and accurate bend formation. This is achieved without the expense, complexity, and other noted limitations associated with an automated bender. Further, the assistive bender stand of the present invention is easily portable by a single individual and may be conveniently stowed in a secure location on site.

These and other advantages of the present invention will become apparent upon review of the following description and the accompanying drawing.

DESCRIPTION OF THE INVENTION

Figure 1:
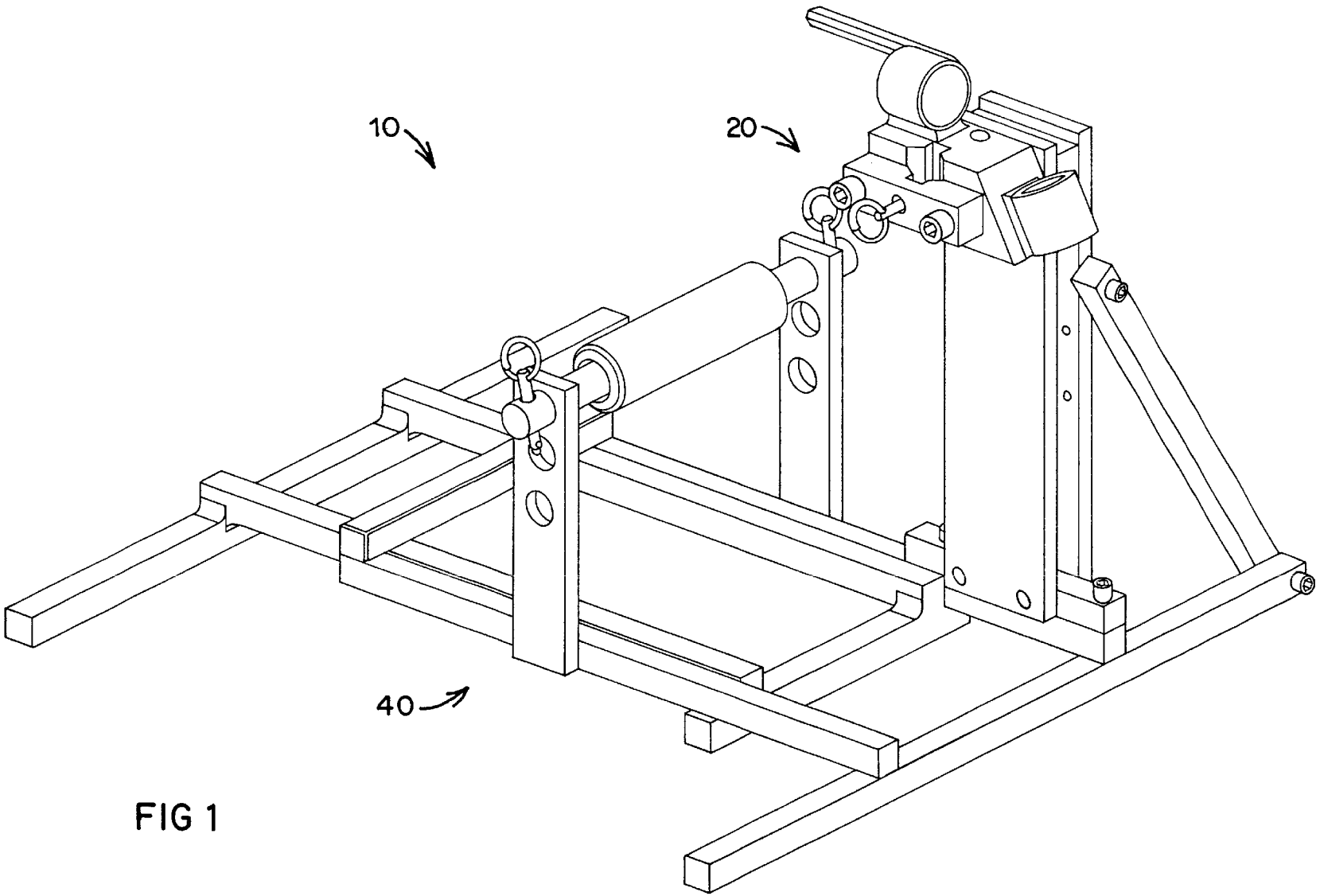
FIG. 1 is a perspective view of the bender stand of the present invention.
Figure 2:
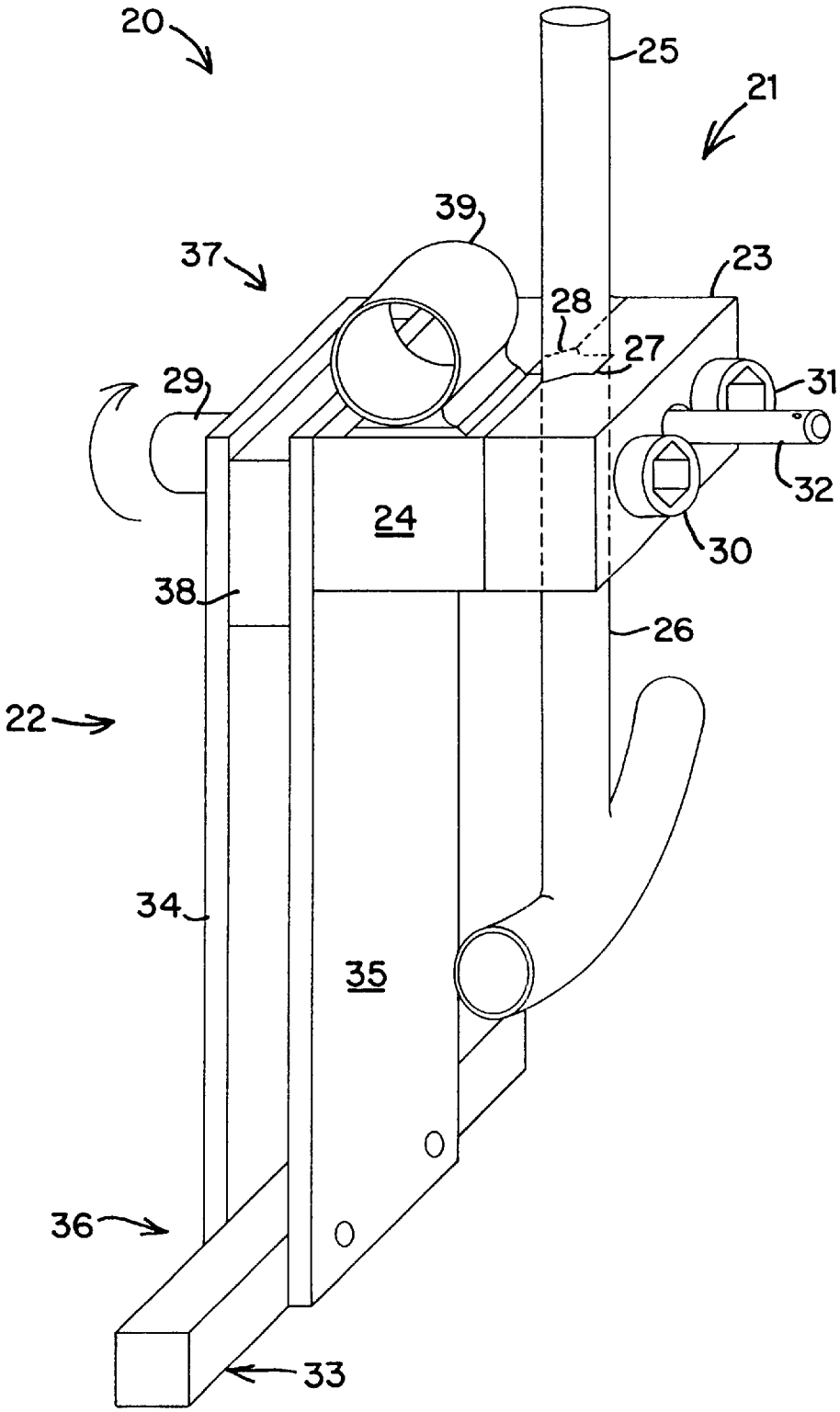
FIG. 2 is a perspective view of the securing frame of the bender stand of the present invention.
Figure 3:
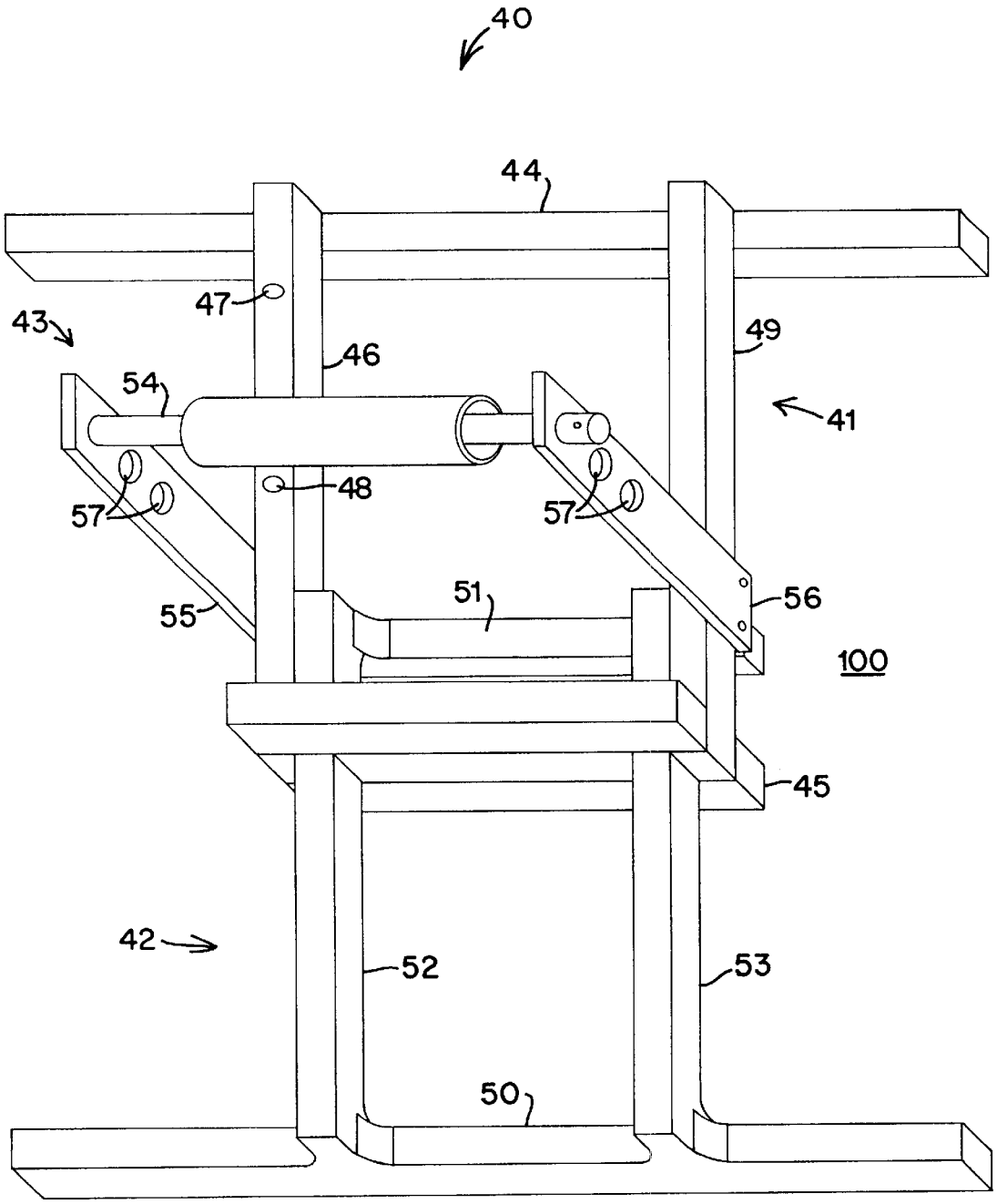
FIG. 3 is a perspective view of the support frame of the bender stand of the present invention.

A bender stand 10 of the present invention is shown in FIG. 1 and includes a bender securing assembly 20 and a base 40. In addition, details of the bender securing assembly 20 are shown in FIG. 2 and details of the base 40 are shown in FIG. 3. The bender stand 10 includes the bender securing assembly 20 connected to the base 40 so that a user may conveniently bend conduit using a hand bender and without jury-rigging a support to keep the conduit in position for accurate bending.

With reference to FIG. 2, the securing assembly 20 includes a rotatable bender securing frame 21 and a support frame 22. The securing frame 21 includes a first securing block 23 and a second securing block 24 for securing a handle 25 of a hand bender 26 therebetween. The first securing block 23 preferably includes a first V-notch 27 and the second securing block 24 preferably includes a second V-notch 28 therein for fixing the position of the handle 25 once the bender 26 is positioned at a desired height with respect to the frame 22.

The securing frame 21 is preferably rotatably affixed to the support frame 22 by way of a captured pivot pin 29 coupled to the second block 24. The first securing block 23 may be adjustably connected to the second securing block 24 by way of threaded bolts, wing bolts, or the like, adjustably positioned within clamping holes 30 and 31. A removable locating pin 32 further acts to fix the handle 25 in position when the stand 10 and the bender 26 are in use. The securing assembly 20 preferably also includes a truncated capture pipe 39 affixed to a top surface of second block 24. That capture pipe 39, which may be formed of one or more components such as is shown in FIG. 1, permits the device user to insert a leverage bar therein in order to provide additional leverage during the bending process and is particularly suitable for use when bending thick-walled conduit.

With continuing reference to FIG. 2, the support frame 22 includes a base coupling bar 33 fixed between support frame members 34 and 35. The base coupling bar 33 is coupled to members 34 and 35 at a first support end 36 thereof. At a second support end 37 the members 34 and 35 are spaced apart from one another by a spacer bar 38 through which the pivot pin 29 passes. The spacer bar 38 is preferably designed to maintain the uniformity of the dimensions of the securing assembly 20 in the area where the handle 25 of the bender 26 is located.

The securing assembly 20 is removably coupled to the base 40 of the stand 10 by way of coupling bar 33 using suitable securing means including, but not limited to, Allen screws and bolts. As illustrated in FIG. 3, the base 40 includes a primary frame 41, an optional base frame extension 42, and, preferably, a conduit support bar assembly 43. The primary frame 41 is designed to provide the structural foundation necessary to generate the leverage generally needed to bend conduit. The primary frame 41 includes a first base member 44 and a second base member 45 that together form the primary foundation of the base 40 and are designed to rest on a fixed substrate 100, such as a floor. A first cross member 46 includes securing assembly-receiving holes 47 and 48 for establishing a releasable fixing of the securing assembly 20 to the base 40. A second cross member 49 establishes the structural reinforcement necessary for the base 40.

With continuing reference to FIG. 3, the frame extension 42 includes a first support bar 50 and a second support bar 51, both of which act together to provide an extended foundation for leverage to bend conduit that is relatively long and/or relatively rigid. The first support bar 50 and the second support bar 51 are coupled using a pair of coupling bars 52 and 53. The coupling bars 52 and 53 are spaced apart such that they are within the spaced dimensions of the cross members 46 and 49 of the primary frame 41. Further, the extension frame 42 is configured such that second support bar 51 is captured within the primary frame 41. Specifically, when the frame extension 42 is fully extended as shown in FIG. 2, second base member 45 blocks bar 51 from moving beyond that point. When the extension frame 42 is moved inward, second base member 45 terminates sliding movement of the extension frame 42 when first bar 50 encounters base member 45.

An additional optional feature of the base 40 is an adjustable conduit support bar 54 that forms a part of support bar assembly 43. The support bar assembly 43 also includes a support bar frame including a first vertical member and a second vertical member 56. The first vertical member 55 is coupled to the first cross member 46 and the second vertical member 56 is coupled to the second cross member 49 of the primary frame 41. Each of the vertical members, 56, includes a plurality of support bar height adjustment sites 57 into which the support bar 54 may be inserted as desired for selection of a conduit height. The support bar 54 may be a single rotatable component made of a metallic or non-metallic material. Preferably, it is a fixed inner bar having a rotatable roller around at least a portion of the inner bar. The support bar 54, in whatever configuration, is designed to ease the bending process and to eliminate conduit pinching that normally occurs when on a fixed substrate 100.

While the invention has been described with reference to a particular example embodiment, it is intended to cover all modifications and equivalents as described by the following claims.

What is claimed is:

1. A conduit bending support device for use in combination with a hand bender, the support device comprising:

a. a support base to provide a stable structural foundation; and b. a securing assembly including a support frame detachably couplable to said support base and a bender securing frame rotatably coupled to said support frame, wherein said bender securing frame includes means for clasping a hand bender in a selectable position.

2. The device as claimed in claim 1 wherein said support base includes a primary frame and a slidable frame extension slidably se cured to said primary frame.

3. The device as claimed in claim 1 wherein said bender securing frame includes a first securing block and a second securing block, wherein said first securing block and said second securing block are movably coupled to one another by support block securing means.

4. The device as claimed in claim 3 wherein said first securing block includes a first V-notch and said second securing block includes a second V-notch aligned with said first V-notch to establish a clamping region such that the hand bender may be releasably secured therein.

5. The device as claimed in claim 4 further comprising a removable locating pin for retaining a handle of the hand bender within said clamping region established by said first V-notch and said second V-notch.

6. The device as claimed in claim 5 further comprising means for securing said first securing block to said second securing block, wherein said means for securing is positioned within clamping holes of said first securing block and said second securing block.

7. The device as claimed in claim 1 further comprising a leverage-assisting device coupled to said bender securing frame.

8. The device as claimed in claim 7 wherein said leverage-assisting device is a capture pipe into which a leverage bar may be inserted to facilitate bending of conduit retained by the hand bender.

9. The device as claimed in claim 1 wherein said bender securing frame is coupled to said support frame with a captured pivot pin for rotatable movement of said bender securing frame with respect to said support frame.

10. The device as claimed in claim 1 wherein said support frame of said securing assembly includes a first support member and a second support member, each of said first support member and said second support member having a first end and a second end, said support frame further comprising a base coupling bar affixed between said first ends of said first support member and said second support member, and a spacer bar affixed between said second ends of said first support member and said second support member.

11. The device as claimed in claim 10 wherein said bender securing frame is rotatably affixed to said first support member, said spacer bar, and said second support member.

12. The device as claimed in claim 10 further comprising means for coupling said base coupling bar to said base.

13. The device as claimed in claim 1 wherein said base includes primary base structure having a first base member and a second base member coupled together with a first cross member and a second cross member, wherein said first cross member includes means for joining said support frame thereto.

14. The device as claimed in claim 13 wherein said base further includes an extension component slidably retained by said primary base structure, said extension component including a first support bar, a second support bar, a first coupling bar and a second coupling bar, wherein said first and second coupling bars connect said first and second support bars together, such that said first and second coupling bars are positioned between said first and second cross members of said primary base structure.

15. The device as claimed in claim 13 further comprising a conduit support assembly affixed to said primary base structure.

16. The device as claimed in claim 15 wherein said conduit support assembly includes a first vertical member coupled to said first cross member, a second vertical member coupled to said second coupling member, and a conduit support bar fixedly positioned between said first vertical member and said second vertical member.

17. The device as claimed in claim 16 wherein each of said first vertical member and said second vertical member of said conduit support assembly includes a plurality of corresponding support bar height adjustment sites for placing said conduit support bar in a selectable position.

18. A conduit bending support device for use in combination with a hand bender, the support device comprising:

a. a support base to provide a stable structural foundation; and b. a securing assembly including a support frame detachably couplable to said support base and a bender securing frame coupled to said support frame, wherein said bender securing frame includes a first securing block and a second securing block, said first securing block and said second securing block being movably coupled to one another for clasping a hand bender in a selectable position.

19. The device as claimed in claim 18 wherein said bender securing frame is fixedly coupled to said support frame.

* * * * *